United States Patent [19]

Clark

[11] 4,361,258

[45] Nov. 30, 1982

[54] ADJUSTABLE CARRYING STRAP

[75] Inventor: Leebert D. Clark, Yoakum, Tex.

[73] Assignee: Torel, Inc., Yoakum, Tex.

[21] Appl. No.: 226,027

[22] Filed: Jan. 19, 1981

[51] Int. Cl.[3] ..... F41C 33/00

[52] U.S. Cl. ..... 224/150; 224/264; 24/68 R; 24/178

[58] Field of Search ..... 224/150, 205, 264; 24/68, 178, 182, 265 A; 69/21, 21.5

[56] References Cited

U.S. PATENT DOCUMENTS 1,396,270 11/1921 Grierson ..... 224/150

2,059,949 11/1936 Imler ..... 224/150

2,357,363 9/1944 Smith et al. ..... 224/150

OTHER PUBLICATIONS

Torel, Inc. 1979-1980, Catalogue, pp. 21-26.

*Primary Examiner*—William Price

*Assistant Examiner*—Gary E. Elkins

*Attorney, Agent, or Firm*—Arnold, White & Durkee

[57] ABSTRACT

An improved carrying strap for attachment to a weapon. The strap may include a main strap element and an adjustment strap element connected to the main strap by a locking ring having an effective clearance passage substantially equal to the thickness of the adjustment strap.

5 Claims, 8 Drawing Figures

ADJUSTABLE CARRYING STRAP

BACKGROUND OF THE INVENTION

1. Field of the Invention

The present invention relates generally to adjustable carrying straps used to carry objects, and more particularly, to an adjustable carrying strap suited for use with an elongated weapon such as a rifle.

2. Description of the Prior Art

Carrying straps for use by individuals are becoming increasingly popular and are receiving widespread attention and acceptance in many different areas of use. Of particular interest with respect to the sporting enthusiast are carrying straps for weapons such as rifles which are not only functional and easy to use, but also attractive and compliment the weapon upon which it is placed.

The prior art as exemplified by those products disclosed in the 1978–1979 catalog of TOREL, INC., Yoakum, Tex., is generally illustrative of various carrying straps for use by individuals on sports rifles. While such devices are generally acceptable for their intended purpose, they have not proven to be entirely satisfactory in that they are often complex to manufacture and are inconvenient and uncomfortable to use. For example, some of the previously existing carrying straps included a shoulder pad having a stiff, sharp edge which may cause the user considerable discomfort when placed adjacent the unprotected neck while the strap is being utilized to carry a rifle. Also, many of the prior art devices have utilized an adjustment means such as a standard belt buckle or a sliding leather buckle which are sometimes difficult to adjust and may become ineffective after extended periods of use.

As a result of these shortcomings of the prior art typified by the above, there has developed and continues to exist a substantial need for an adjustable carrying strap which is easy to adjust and remains in the adjusted position while being comfortable for the user to utilize. In spite of this need and the efforts of many individuals and companies to develop such devices, a sturdy, reliable and comfortable carrying strap has heretofore been unavailable.

SUMMARY OF THE INVENTION

Therefore, a feature of the present invention is an adjustable carrying strap for attachment to an article to be carried which can be easily attached to and removed from the object while providing quick and effective adjustment in the overall length of the strap.

Another feature of the present invention is to provide a carrying strap which does include smooth, soft edge members along its pad portion.

Additionally, a feature of the present invention is to provide a carrying strap which includes a pad portion which is securely attached to the strap portion.

A still further feature of the present invention is the provision of a carrying strap having a securely attached pad portion which can be attractively decorated with inlays, paintings, embossing or printing.

Also a feature of the present invention is an adjustable carrying strap which has means for easily and quickly adjusting the overall length of the strap.

Finally, a feature of the present invention is the process of securely attaching the pad portion of a carrying strap to a main strap element in such a manner as to provide a carrying device which may be easily manufactured and yet attractively decorated after assembly.

The present invention is summarized in that an adjustable carrying strap for attachment to an object such as a rifle includes a main strap with one end adapted for attachment directly to the rifle, an adjustment means for selectively adjusting the overall length of the carrying strap and a shoulder pad attached to the main strap portion having at least a pair of longitudinal side sections having a substantially circular cross-sectional shape.

So that the manner in which the above-recited features and advantages of the present invention, as well as others which will become apparent, are attained and can be understood in detail, more particular description of the invention, briefly summarized above, may be had by reference to the embodiment thereof which is illustrated in the appended drawings which form a part of this specification.

It is to be noted, however, that the appended drawings illustrate only a typical embodiment of the invention and are therefore, not to be considered limiting of its scope, for the invention may admit of other equally-effective embodiments.

DESCRIPTION OF THE PREFERRED EMBODIMENTS

Figure 1:
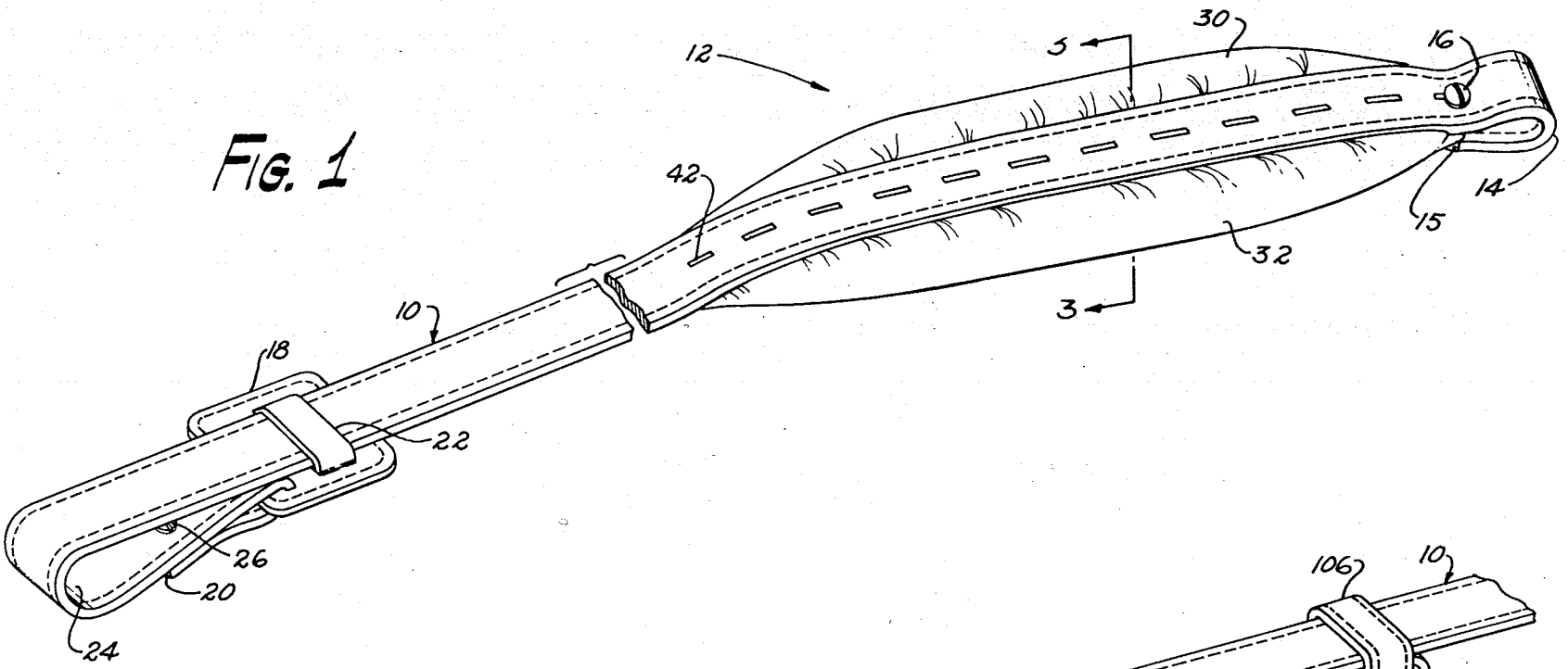
FIG. 1 is a perspective view of a preferred embodiment of an adjustable carrying strap for attachment to an object according to the present invention.
Figure 2:
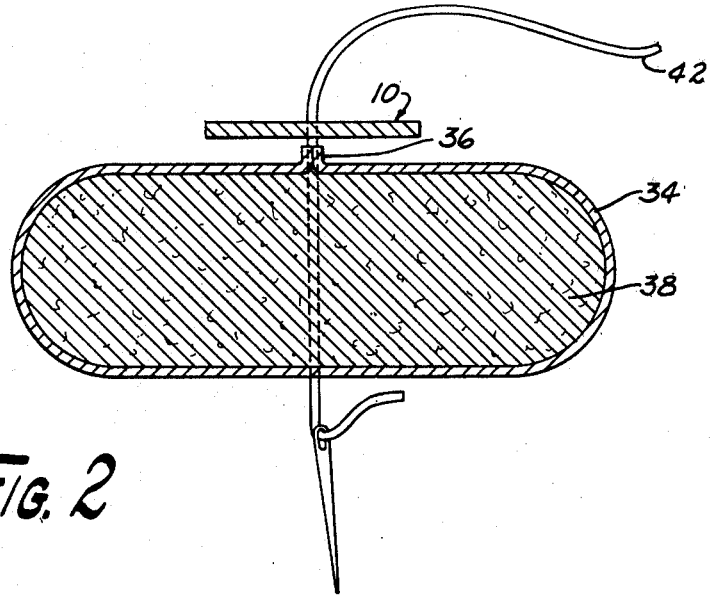
FIG. 2 is a cross-sectional view of the pad portion of the device of FIG. 1 prior to attachment to the main carrying strap element.
Figure 3:
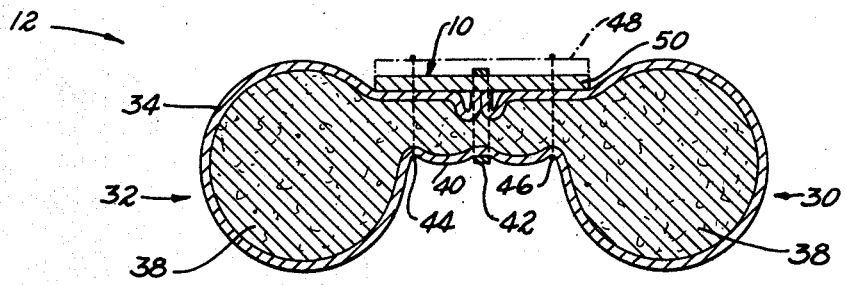
FIG. 3 is a cross-sectional view taken along line 3—3 of FIG. 1 showing the shoulder pad portion attached to the main strap element.

Referring first to FIGS. 1 through 3, a preferred embodiment of an adjustable carrying strap for attachment to an object such as an elongated weapon such as a rifle in accordance with the present invention is shown. Although the present description is directed toward the use of the carrying strap on a weapon, it is to be understood that the strap of the present invention is equally well suited for use on any object to be carried such as luggage or purses. Shown generally in FIG. 1, the present invention includes a main strap member 10 having a generally curved, crescent shaped shoulder pad with tapered ends 12 attached thereto. The main strap member 10 is a generally narrow, flat strip of a flexible material having sufficient strength to support the weight of the object to which the strap is attached. As for example and without limitation, the main strap member 10 may be constructed of any suitable material such as leather or heavy canvas and the like. Applicant has found that leather generally referred to as single-ply cowhide is suitable for most purposes.

The main strap member 10 in FIG. 1 has one of its ends adapted for attachment directly to the weapon to be carried. In the embodiment of FIG. 1, this attachment means takes the form of an end loop 14. End loop 14 is formed by bending a portion of strap member 10 back up to itself and generating a curved portion near the end of strap 10 and fastening the end portion back unto itself in position on the under side of the strap 10 as shown in FIG. 1. Although any suitable means may be used to fasten this end portion in place, forming the loop, the embodiment of FIG. 1 incorporates a nut and bolt combination 16 sometimes referred to as a "Chicago screw and nut". It is to be understood that any suitable fastening means may be used in place of the nut and bolt combination 16 in order to form the end loop 14.

As can be appreciated, the formation of end loop 14 allows the strap 10 to be securely attached to a weapon such as a rifle. To accomplish this attachment, the end 15 of strap 10 is passed through a bracket or swivel (not shown) mounted on the rifle, the bracket or swivel being designed specifically for attachment of such carrying straps. The end loop 14 is then formed by curving the end portion of main strap member 10 as shown in FIG. 1 and the nut and bolt combination 16 is then inserted into position as shown in FIG. 1 through a pair of apertures which have been previously formed in the strap and aligned for receiving nut and bolt member 16. By securing the nut and bolt combination 16, the end loop 14 is securely held in position thereby securing that end of the carrying strap to the elongated weapon.

FIG. 1 also discloses one embodiment of a means for selectively adjusting the overall length of the carrying strap. In particular, this embodiment utilizes a slide buckle means 18 mounted on the central portion of the main strap member 10. Slide buckle means 18 is attached to the end of main strap member 10 opposed from the end loop 14. Buckle 18 is so mounted by sliding main strap end 20 through the loop portion 22 of buckle 18 and bending the main strap portion which has been passed through loop portion 22 so that a larger, second end loop 24 is thereby formed. Strap end 20 is then connected to the buckle 18 by means of a second nut and bolt combination 26 as shown in FIG. 1.

As can be appreciated from an examination of FIG. 1, the second end loop 24 forms essentially the end of the main strap member opposed from end loop 14 and can be attached to a second bracket or swivel (not shown) mounted on the weapon spaced from the first bracket or swivel into which end loop 14 has been attached. By passing end 20 through the second bracket or swivel mounted on the rifle after slide buckle 18 has been mounted on the main strap 10, end 20 of the main strap is re-attached to the lower portion of buckle 18 by nut and bolt combination 26. Such an attachment results in the main strap 10 being attached to a pair of spaced brackets or swivels carried by the weapon. As a result of the elongated carrying strap being attached at both ends of the weapon, the user of the weapon may now utilize the carrying strap as a sling. The weapon may be carried on the user's shoulder with the pad portion 12 resting on one shoulder or the weapon may be worn across the user's back with the carrying strap passing across the chest of the user as is quite well known in the art.

The buckle 18 may be selectively positioned along the length of the main strap 10 thereby adjusting the overall length of the carrying strap. As can be understood from an examination of FIG. 1, as the buckle 18 is slid along the strap 10 in a direction toward the pad 12, the effective overall length of the carrying device is shortened since the loop portion of end loop 24 is thereby enlarged.

Figure 5:
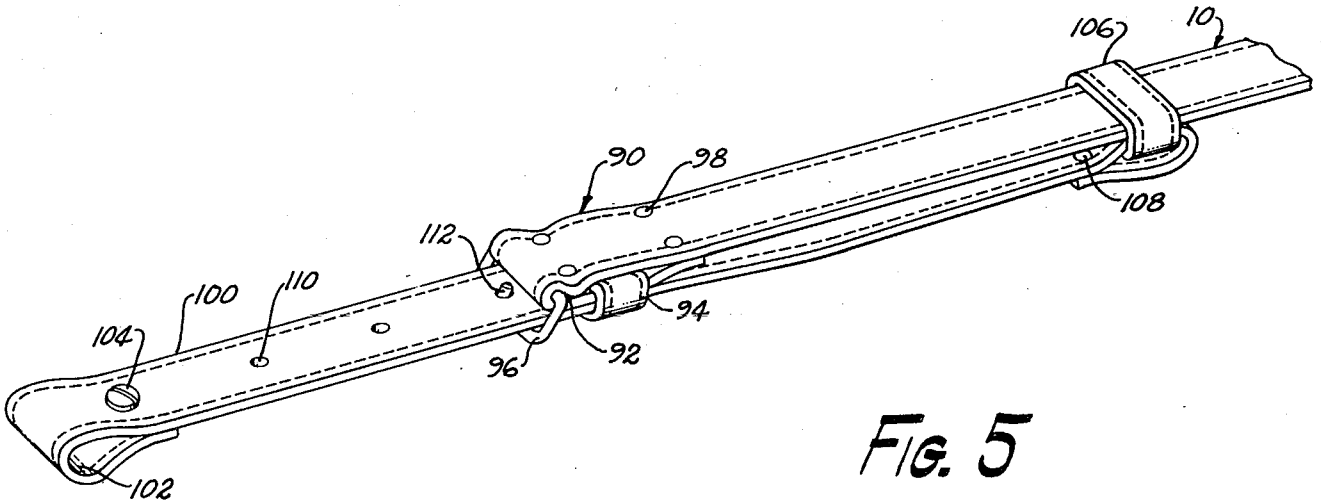
FIG. 5 is a perspective view of another embodiment of an adjustment means for the carrying strap.

As can be appreciated, buckle 18 may be replaced with any one of several other means of adjusting the overall length of the strap. For example, the embodiment shown in FIG. 5 provides for a second separate adjustable strap 100 which has its first end 102 attached directly to the weapon at the second bracket or swivel with the adjustment strap's second end being selectively attached along the length of the main strap 10. This second end of the adjustment strap 100 may have any type of fastener or buckle attached thereto which engages the loose end of the main strap member 10 and holds it by a catch means. Such an embodiment would allow the overall length of the carrying strap to be adjusted by selectively positioning the fastener or buckle along the length of the main strap member 10.

Referring back again to FIGS. 1 and 3, a shoulder pad 12 is shown attached to the main strap member 10. Pad 12 is generally crescent shaped when viewed in a front elevation view to conform to the curvature of the shoulder of the user when used to carry the weapon. In addition to this overall crescent shape, the pad 12 is longitudinally tapered on each end as seen in FIG. 1 such that the width of the pad at each end is substantially equal to the width of the main carrying strap 10 with the pad's central portion having a width more than twice the width of the main carrying strap 10.

As shown in FIG. 3, which is a cross-sectional view of the central portion of the pad 12 attached to main strap 10 taken in a plane substantially perpendicular to the longitudinal axis of the main strap member 10, the pad 12 includes at least two longitudinal side portions 30, 32 having a generally circular cross-sectional shape. These side sections 30, 32 run longitudinally substantially the full length of the pad 12 and provide a tapered, curvilinear surface forming the outermost edges of the pad. As will be more fully explained, these curved surface elements eliminate undesirable sharp corners and edges which may cause discomfort to the user.

The shoulder pad 12 also includes a pliable cover 34 of unitary construction. As can be seen more clearly in FIG. 2, cover 34 consists of a single piece of pliable material such as soft leather or glove leather, which has been cut such that when the longitudinal edges are joined by a single seam 36, the tapered pad is formed.

Referring back to FIG. 3, a compressable inner body portion 38 is shown encased with the cover 34. This inner body forms the soft, cushion part of the pad 12 and may be constructed of any suitable material such as foam rubber, felt, hair or any other resilient material. The overall shape of the inner body 38 prior to attachment to main strap 10 can be seen in the cross-sectional view of FIG. 2.

Referring back to FIG. 3 again, one method of attaching the pad 12 to the main strap member 10 is disclosed. After the inner body 38 has been encased within the cover 34 by connecting the longitudinal edges of cover 34 by seam 36, the pad is placed in position along the underside portion of main strap member 10 (as shown in FIG. 2). When properly positioned, the longitudinal central portion of the pad between the side sections 30, 32 and shown generally at 40 in FIG. 3 and is generally aligned with the main strap member 10 as shown. At this time, a flexible cord or thread 42 is laced, typically with the use of a needle (see FIG. 2), through the main strap element 10 and the central portion of the pad 12. As more clearly seen in FIGS. 1, 2 and 4, the flexible thread or cord 42 is laced or stitched along the length of the pad 12 such that the pad 12 is securely held to the main strap 10. Also as seen in FIG. 3, the thread 42 is stitched in place with sufficient force as to compress that portion of the inner body 38 located between the side sections 30, 32. The cord or thread 42 may be made of any suitable flexible material capable of being formed into a thread-like object such as leather, textile thread or high strength plastic.

In addition to attaching the pad 12 to the strap 10 by means of the lacing process utilizing thread 42, the embodiment disclosed in FIG. 3 may include a pair of seams formed by passing a plurality of stitches 44, 46, typically textile thread, along the edge portion of the main strap 10. The stitches 44, 46 provide additional strength and overall security to the assembly. Stitches 44, 46 also are sewn in place with sufficient tension as to compress inner body portion 38 thereby forming a central channel 40. As can be understood, an alternative means of attachment may be the use of a pair of cords or threads 42 along the edge portion of the main strap 10 rather than the single cord of FIG. 2 or the single cord and stitches 44, 46.

Figure 4:
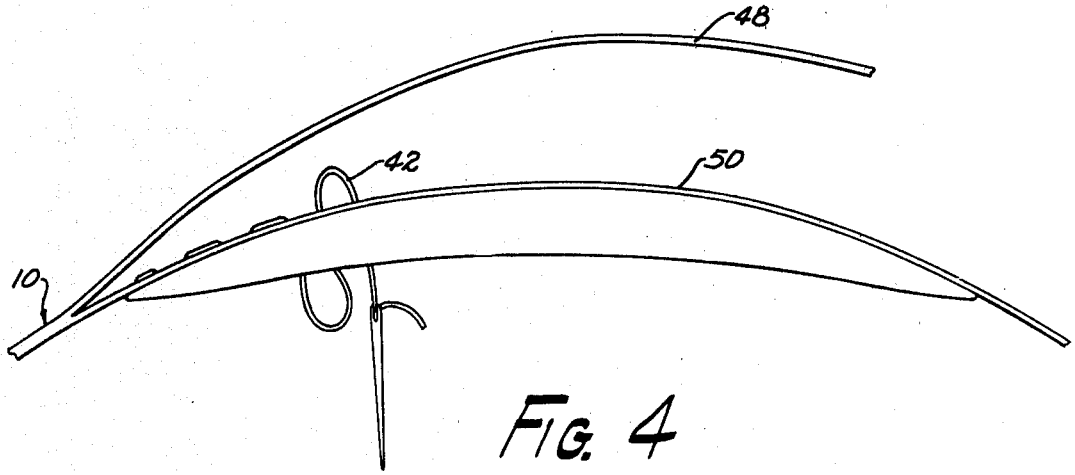
FIG. 4 is a partial perspective view of a second embodiment of the present invention showing the device during construction.

A second embodiment of the present invention is shown in FIG. 4. In this embodiment, an end portion of the main strap member 10 has been split into an upper piece 48 and a lower attachment piece 50. This separating process simply splits the strap along a longitudinal plane parallel to the longitudinal axis of the main strap 10 as shown in FIG. 3.

Referring back to FIG. 4, there is also shown the pad 12 which is laced longitudinally to only the lower piece 50 of the main strap element 10. After the cord 42 has been fully laced in position and tied at each end, the upper piece 48 of the main strap 10 is then overlapped onto the lower piece 50. Piece 48 may be held in position by use of an adhesive material such as glue. This essentially places the upper piece 48 and lower piece 50 back into their respective positions prior to the separating process. After overlapping pieces 48 and 50, a plurality of stitches 44, 46 is passed through the upper piece 48, lower piece 50 and the longitudinal central portion of pad 12 as shown in FIG. 3, piece 48 being shown in dotted line. As can be understood from an examination of FIGS. 3 and 4, this embodiment enables the pad 12 to be securely laced to the lower piece 50 of the main strap 10 by the thread 42 without the thread 42 being visible along the top surface of the main strap 10 by virtue of upper portion 48 being re-attached thereto. By concealing the stitches formed by cord 42, it is now possible to place ornamental designs, inlays, cut-outs and other decorative items on the outer surface of the upper piece 48 thereby adding significantly to the overall appearance of the carrying strap. Also, the benefit of utilizing a heavy strength thread such as 42 in order to secure the pad 12 to the carrying strap 10 is thereby accomplished without detracting from the overall appearance of the pad portion of the gun sling.

The present invention is also concerned with a novel adjustment means for a carrying strap. In the preferred embodiment of this adjustment means, a second adjustment strap is used with a novel locking ring. Referring specifically to FIGS. 5–8, an embodiment of this new adjustment means is shown. Specifically, the embodiment shown in FIG. 5 includes the main strap member 10 as previously discussed which has one end attached to the object to be carried as previously described. The second end 90 of the main strap 10 is shown forming a ring loop 92 engaging a first keeper loop 94 and locking ring 96. The ring loop 92 is held in position by a suitable attachment means such as for example brads 98.

An adjustable strap element 100 is also shown in FIG. 5 which has one of its ends adapted for attachment to the object to be carried, such as for example by the end loop 102 held in position by a nut and bolt combination 104. The other end of the adjustment strap 100 is shown in FIG. 5 as passing through locking ring 96 and first keeper loop 94 and attached to a second keeper loop 106. Although loop 106 is secured to adjustment strap 100 by brads 108, loop 106 is free to slide along the length of the main strap 10 during the adjustment process. Adjustable strap 100 also includes a plurality of centrally aligned aperatures 110 which are selectively engaged by the finger 112 of locking ring 96 as shown in FIG. 5. The position of the locking ring shown in FIG. 5 is defined as the "fully locked" position since finger 112 is fully inserted into aperature 110 and securely attaches adjustment strap 100 to main strap 10.

Figure 8:
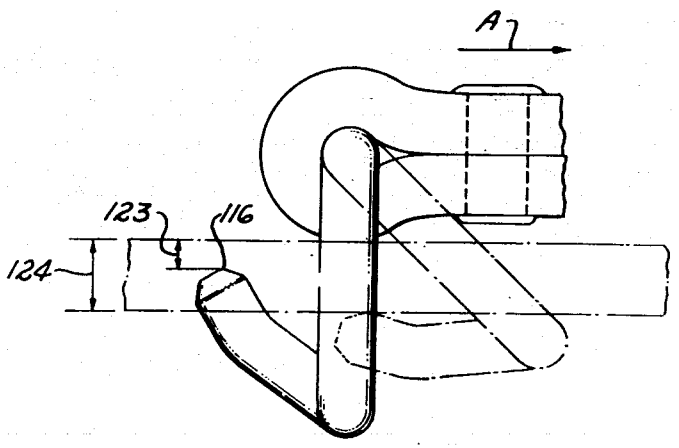
FIG. 8 is a side elevation view of the locking loop portion of FIG. 7.
Figure 7:
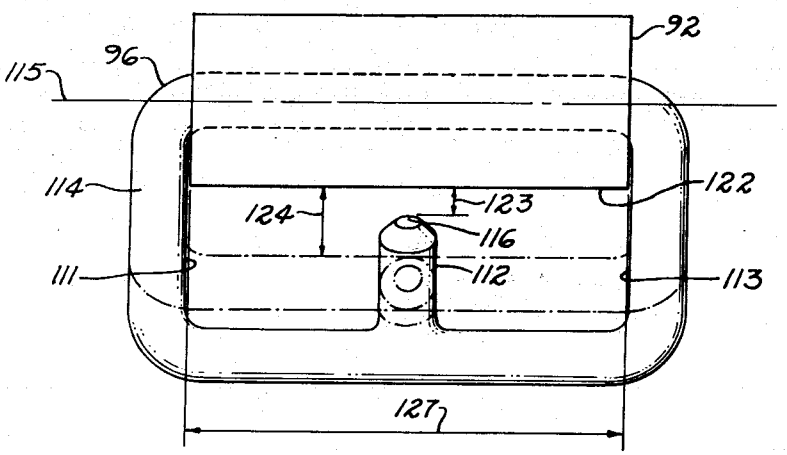
FIG. 7 is a front view of the locking loop portion of the adjustment means of FIG. 6 without the adjustment strap inserted through the locking loop.
Figure 6:
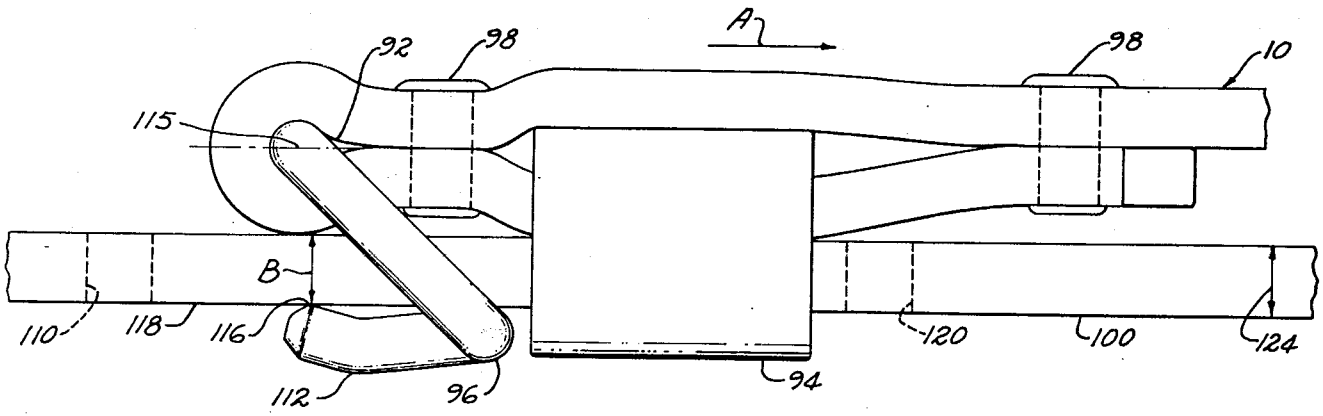
FIG. 6 is an elevation view of a portion of the adjustment means of FIG. 5 shown in the cocked position during the adjustment operation.

Referring now to FIGS. 6–8, the novel operation of the locking ring 96 will be explained. The locking ring 96 consists primarily of two elements, a generally rectangular frame segment 114 with a curved prong or finger 112, rigidly attached to the lower portion of frame 114. The locking ring 96, shown in its "cocked position" in FIG. 6, is used to adjust the overall length of the carrying strap and retain this length during use. For example, if the user wishes to increase the overall length of the carrying strap, it is necessary to reposition the locking ring 96 to an aperature 110 located to the right of the present position of ring 96 as shown in FIG. 5.

To accomplish this adjustment, the user simply rotates the locking ring 96 from its "fully locked position" shown in FIG. 5 to the "cocked position" as shown in FIG. 6. This cocking is accomplished by rotating the ring 96 about the axis 115, shown in FIGS. 6 and 7. That portion of frame segment 114 through which axis 115 passes is rotatably mounted within loop 92 of strap 10. As the ring 96 is placed in the "cocked position", the finger 112 is removed from aperature 110 and the end point 116 of finger 112 is caused to engage the surface 118 of adjustment strap 100. As the operator exerts a pulling force on strap 10 in the direction shown by arrow A in FIG. 6 while holding adjustment strap 100 stationary, strap 10 is moved in the direction of arrow A with respect to adjustment strap 100. This relative movement causes finger 112 to slide along end point 116 on surface 118. Since the effective clearance passage (as defined herein) of the locking ring 96, while in the "cocked position" shown in FIG. 6, is substantially equal to the thickness of the adjustment strap 100, shown by the dimension B of FIG. 6, finger 112 slides along surface 118 while exerting a force substantially perpendicular to the plane of strap 100. This downward force results from the ring 96 having a tendency to rotate about axis 115 due to the pulling force exerted in the direction of arrow A in FIG. 6 and the frictional engagement of finger 112 at end point 116 on surface 118. Therefore, as main strap 10 is moved in the direction of arrow A with respect to strap 100, finger 112 slides along surface 118 until it reaches an adjacent aperature 120 of FIG. 6. At that time, continued force in the direction of arrow A causes the finger 112 to "drop" or "pop" automatically into aperature 120 without exerting additional force or effort to seat the ring 96 in the "fully-locked position". After finger 112 has dropped into aperature 120, the adjusting operation is complete and the operator has effectively increased the overall length of the carrying strap.

Referring to FIGS. 7 and 8, an example of the precise dimensional relationship of the locking ring 96 and the adjustment strap 100 can be seen. FIG. 7 shows the locking ring 96 attached to the main strap 10 by ring loop 92. As shown in FIG. 6, the adjustment strap 100 passes through the opening formed by two sides 111, 113 of the locking frame 114, the end point 116 of finger 112 and the surface 122 of loop 92. As will be understood, the size of this opening will be dependent upon the angular position of locking ring 96 with respect to strap 10. This opening is hereafter referred to as the effective clearance passage of the locking ring 96. In the "down position" as shown in solid lines in FIG. 8, the plane formed by the locking frame 114 is substantially perpendicular to the plane formed by main strap 10 and adjustment strap 100. In this "down position", the effective clearance passage formed by the surface 122, the side portions 111, 113 of frame 114 and the end point 116, is substantially less than the cross-sectional size of the adjustment strap 100 since the dimension shown by numeral 123 in FIG. 8 is less than the thickness of the adjustment strap 100 shown by the dimension 124 in FIGS. 6 and 8. However, when the locking ring 96 is placed in the "cocked position" as previously defined and shown in dotted lines in FIGS. 7 and 8, the effective clearance passage is substantially equal to the size of the adjustment strap 100 since the distance between end point 116 and surface 122 is increased as shown by the dimension shown by numeral 124 in FIG. 8. This distance 124 is substantially equal to the thickness of the adjustment strap 100. It will also be noted that the width of the effective clearance passage, as shown by dimension 127 in FIG. 7, is substantially equal to the width of adjustment strap 100 which in turn is equal to the width of the opening formed by frame section 114. This relationship causes finger 112 to be aligned with the plurality of aperatures 110 which have been placed in adjustment strap 100. Therefore, as finger 112 is slid along surface 118, finger 112 is continuously aligned properly with aperature 110.

As a result of this effective clearance passage in the "cocked position" as defined herein, having a height substantially equal to the thickness of the adjustment strap 100, locking ring 96 simply slides along surface 118. Also, since the locking ring 96 is in a cocked angle with respect to the strap 10 and the force being exerted upon ring 96 by main strap 10 is in the direction of arrow A of FIG. 6, the finger 112 is caused to automatically "pop" into the selected aperature 110 as previously described.

Further modifications and alternative embodiments of the apparatus and process of this invention may be apparent to those skilled in the art in view of this description. Accordingly, this description is to be construed as illustrative only and is for the purpose of teaching those skilled in the art the manner of carrying out the invention. It is to be understood that the forms of the invention herein shown and described are to be taken as the presently preferred embodiment. Various changes may be made in the shape, size and arrangement of parts. For example, equivalent elements or materials may be substituted for those illustrated and described herein, parts may be reversed and certain features of the invention may be utilized independently of the use of other features, all as would be apparent to one skilled in the art after having the benefit of this description of the invention.

I claim:

1. An adjustable carrying strap for attachment to an object to be carried which comprises:

a main strap element having a first end and a second end, said first end adapted for attachment to the object;

an adjustment strap element having a first end and a second end, said second end of the adjustment strap adapted for attachment to the object;

a locking ring rotatably connected to the second end of said main strap and adapted for receiving and selectively engaging said adjustment strap element, said locking ring having an effective clearance passage in the cocked position substantially equal to the thickness of said adjustment strap element; and means on the main strap element responsive to a force on the main strap element for automatically locking the main strap to the adjustment strap element.

2. In an adjustable carrying strap for attachment to an elongated weapon having a main strap coupled to an adjustment strap having a plurality of longitudinally aligned aper tures, the improvement which comprises:

a locking ring rotatably joined to the main strap and adapted for selectively engaging said adjustment strap, said locking ring having an effective clearance passage in the cocked position equal to the thickness of said adjustment strap; and means on the main strap responsive to a force on the main strap for automatically locking the main strap to the adjustment strap.

3. In an adjustable carrying strap as recited in claim 2 wherein the locking means includes:

the locking ring having a ridge frame section of a width substantially equal to the width of said adjustment strap; and a curved finger rigidly attached to said frame section and adapted for selective insertion into said adjustment strap aper tures.

4. An adjustable carrying strap for attachment to an object to be carried, said carrying strap comprising:

a main strap element having a first end and a second end, said first end adapted for attachment to the object;

a first keeper loop slidably mounted on said main strap;

an adjustment strap element having a first end, a second end and a series of longitudinally aligned aper tures, said second end of the adjustable strap element adapted for attachment to the object and said first end attached to said first keeper loop;

a second keeper loop attached to said main strap and slidably engaging said adjustment strap;

a locking ring rotatably attached to the second end of said main strap and adapted for encircling said adjustment strap and selectively engaging said aper tures of said adjustment strap element, said locking ring having an effective clearance passage in the cocked position substantially equal to the thickness of said adjustment strap; and means on the main strap element responsive to a force on the main strap for automatically locking the main strap to the adjustment strap.

5. The carrying strap as recited in claim 4 wherein the locking means includes said locking ring having a rigid frame portion of a width substantially equal to the width of said adjustment strap and a curved finger rigidly secured to said frame portion.

* * * * *